United States Patent [19]

Ando

[11] 3,967,096

[45] June 29, 1976

[54] ELECTROMAGNETIC COUNTERS WITH MECHANICAL ACTUATED LOCKING

[75] Inventor: Soichi Ando, Yonezawa, Japan

[73] Assignee: Tamura Electric Works, Ltd., Tokyo, Japan

[22] Filed: Oct. 7, 1974

[21] Appl. No.: 512,402

[52] U.S. Cl. ..... 235/92 C; 235/92 R

[51] Int. Cl.[2] ..... G06M 3/12

[58] Field of Search ..... 235/92 C, 92 CT, 92 FP, 235/130 R, 131 R, 131 JA

[56] References Cited

UNITED STATES PATENTS 2,822,983 2/1958 Sengebusch ..... 235/92 C 3,436,530 4/1969 Faude et al. ..... 235/92 CT

*Primary Examiner*—Joseph M. Thesz

*Attorney, Agent, or Firm*—Charles E. Pfund

[57] ABSTRACT

In an electromagnetic counter of the type wherein a digit wheel is operated by an armature of an electromagnet through a pawl, locking means is provided for locking the armature before the counter is mounted in position. When the counter is mounted in position, a rod is operated to release the locking means thus permitting normal operation of the counter.

3 Claims, 4 Drawing Figures

ELECTROMAGNETIC COUNTERS WITH MECHANICAL ACTUATED LOCKING

BACKGROUND OF THE INVENTION

This invention relates to an electromagnetic counter.

A prior art electromagnetic counter provided with a plug-jack connector for connecting the counter with an associated signal circuit has a defect that the digit wheels thereof are rotated by shocks applied to the counter while it is being transported or stored because the prior art electromagentic counter is not provided with any locking means for locking the armature of the electromagnet and pawls operated by the armature.

SUMMARY OF THE INVENTION

It is an object of this invention to provide an improved electromagnetic counter including locking means for preventing misoperation of the counter.

Another object of this invention is to provide an improved electromagnetic counter including locking means which locks the armature and hence the digit wheel against accidental movement before the counter is mounted in position but unlocks automatically the armature and digit wheel when the counter is mounted in position on an instrument panel, for example.

Briefly stated in accordance with this invention there is provided an electromagnetic counter of the type wherein a digit wheel is operated by an armature of an electromagnet through a pawl, and the digit wheel, pawl, armature and electromagnet are mounted on a supporting frame, characterized in that there are provided locking means for locking the movement of the armature and means supported by the frame for releasing the locking means when the frame is mounted in position.

According to a preferred embodiment of this invention, the locking means comprises a leaf spring with one end secured to the supporting frame and the other end projected in the path of movement of the armature and the means for releasing the locking means comprises a rod slidably mounted on the frame. With this construction until the counter is mounted in position the armature and hence the digit wheel are locked against accidental movement but unlocked automatically when the counter is mounted in position.

BRIEF DESCRIPTION OF THE DRAWING

Further objects and advantages of the invention can be more fully understood from the following detailed description taken in conjunction with the accompanying drawing in which.

DESCRIPTION OF THE PREFERRED EMBODIMENT

Figure 3:
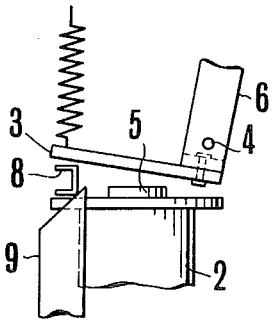
FIG. 3 is a partial sectional view taken along a line B—B' shown in FIG. 1 in which the locking device is shown in the operated condition.

The electromagnetic counter shown in the accompanying drawing comprises terminals 1, a coil connected to the terminals 1 and wound upon a magnetic core 5 for operating an armature 3, a pawl 6 pivotally mounted on a pin 4 and connected to one end of armature 3 and a plurality of digit wheels 7, the first digit wheel being stepped by the pawl 6 through a ratchet wheel 17 mounted on the shaft 18 of the digit wheels 7. A channel shaped leaf spring 8 is provided to cooperate with the upper end of a rod 9 which is normally biased toward its lower position so as to disengage from spring 8 by a spring 10. A U shaped frame 11 is provided in a casing 19 for supporting component parts described above.

One end of spring 8 is secured to one leg of the supporting frame 11 so that under normal condition the other end of the spring 8 is positioned to the lower side of the armature 3 thus locking the pawl 6 and digit wheels against accidental movement, as shown in FIG. 3.

Figure 4:
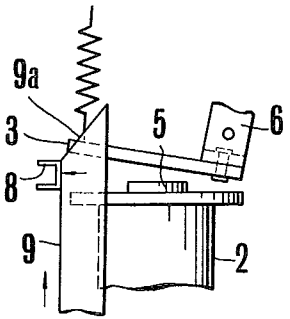
FIG. 4 shows a view similar to FIG. 3 but in which the locking device is shown in the unlocked condition.
Figure 2:
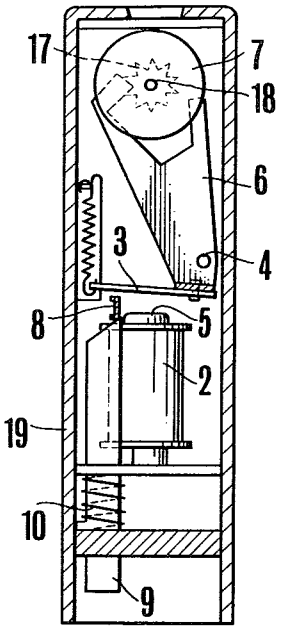
FIG. 2 is a longitudinal sectional view of the electromagnetic counter shown in FIG. 1 taken along a line A—A'.
Figure 1:
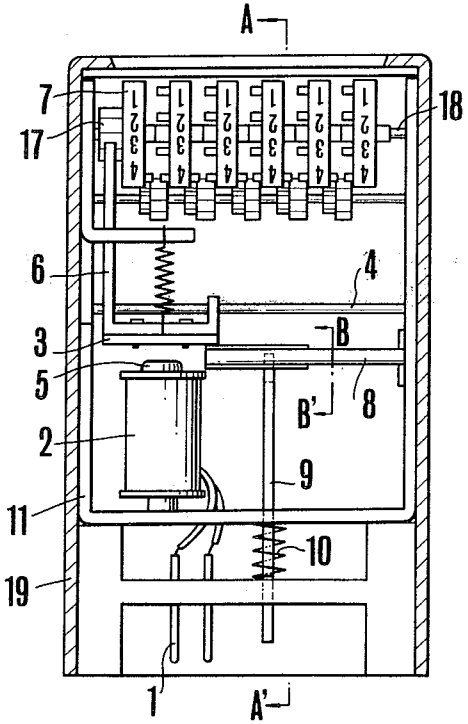
FIG. 1 is a front elevation of one embodiment of this invention.

When the counter is mounted in position, that is, its terminals 1 are inserted in sockets (not shown), the rod 9 is pushed upwardly as viewed in FIG. 1. The upper end of the rod 9 is bevelled as at 9a so that when the rod 9 is moved upwardly the spring 8 is moved to the left as viewed in FIG. 4, thus unlocking the armature 3. Consequently, when the coil 2 is energized, the armature 3 is attracted by the core 5 and rotates in the counterclockwise direction about pin 4 together with the pawl 6. Thus, each time the coil 2 is energized the digit wheel 7 of the lowest order of magnitude is stepped one digit.

According to this invention, as the terminals or plugs 1 are inserted in the socket and the counter is mounted in position, the locking device is unlocked thus permitting normal operation of the counter. However, until the terminals 1 are inserted into the socket, that is while the electromagnetic counter is being stored or transported, the locking device locks the armature and pawl, thus preventing misoperation of the digit wheels.

Instead of vertically extending the rod 9 it may be projected from the side surface of the frame 11 so that the rod 9 is operated when the counter is mounted in position (for example on an instrument panel).

What is claimed is:

1. In an electromagnetic counter provided with a plug socket and adapted to be plugged into a socket holder wherein a digit wheel is operated by an armature of an electromagnet through a pawl, and said digit wheel, pawl, armature and electromagnet are mounted on a supporting frame, the improvement which comprises a member for locking the armature which is adapted to be pivoted between said armature and said electromagnet under spring bias, and a rod displaceable against spring bias to cause said member to deviate from the region between said armature and said electromagnet, said rod extending from said plug socket and displaced upon plugging the counter into said socket holder.

2. The electromagnetic counter according to claim 1 wherein said member pivotable under spring bias is a leaf spring with one end secured to said frame and the other end freely projected into the path of movement of said armature.

3. The electromagnetic counter according to claim 2 wherein one end of said rod engaging the free end of said leaf spring in the locking position is bevelled, so that as said rod moves, the free end of said leaf spring is deviated from said region between said armature and said electromagnetic under bending of said leaf spring.

* * * * *